United States Patent [19]

Crepin

[11] 3,983,820

[45] Oct. 5, 1976

[54] PROJECTILE HAVING A LIGHTENED BASE

[75] Inventor: Roger Crepin, Paris, France

[73] Assignee: Thomson-CSF, Paris, France

[22] Filed: Aug. 1, 1974

[21] Appl. No.: 493,826

[30] Foreign Application Priority Data

Aug. 9, 1973 France ..... 73.29180

[52] U.S. Cl. ..... 102/92.6; 102/49.3; 102/56 R; 102/92.1

[51] Int. Cl.[2] ..... F42B 13/12; F42B 13/28

[58] Field of Search ..... 102/92.4, 92.6, 92.3, 102/92.1, 56–59, 49.3, 49.7, 49.8, 103

[56] References Cited

UNITED STATES PATENTS

| | | | |
|---|---|---|---|
| 2,056,098 | 9/1936 | Garlak, Jr. | 102/56 |
| 2,246,429 | 6/1941 | Brandt | 102/92.6 |
| 2,373,883 | 4/1945 | Ferrel | 102/56 |
| 2,507,878 | 5/1950 | Banning, Jr. | 102/92.6 |
| 2,877,504 | 3/1959 | Fox | 102/103 |
| 2,922,368 | 1/1960 | Lyon | 102/92.6 |
| 3,374,740 | 3/1968 | Voda | 102/92.6 |
| 3,628,457 | 12/1971 | Magnusson et al. | 102/49.3 |

FOREIGN PATENTS OR APPLICATIONS

| | | | |
|---|---|---|---|
| 828,487 | 5/1938 | France | 102/92.4 |
| 126,153 | 9/1949 | Sweden | 102/49.3 |

*Primary Examiner*—Charles T. Jordan
*Attorney, Agent, or Firm*—Edwin E. Greigg

[57] ABSTRACT

A projectile having an elongated body portion to the aft end of which is attachable a base constructed of thinner metal than the projectile body, there further being an isotropic charge positioned in the projectile which is subjected to pressure via the base when the charge is exploded in a gun barrel. Also taught is a method of assembling the charge into the projectile.

9 Claims, 10 Drawing Figures

PROJECTILE HAVING A LIGHTENED BASE

BACKGROUND OF THE INVENTION

The invention relates to improvements in projectiles having a lightened base and, more particularly to the type of projectile which is fired from the breech of a gun, that is to say a projectile the rear of which is subjected to the pressure of expanding gases during the firing phase.

Known types of projectiles, because of their weight, offer considerable resistance to firing and inordinate amounts of explosive powder have frequently been used with disastrous results.

One improvement to reduce resistance between the projectile and the rifling lands in the gun barrel was the creation of the bourrelet rim which was provided between the ogive and a rearwardly disposed rim or band that was spaced therefrom and used to receive the driving force of the explosive gases.

In addition, the base of a projectile, which is a considerable proportion of the total mass, constributes nothing whatsoever to the effectiveness of the projectile. As regards penetrating properties, any increase in the mass of the base only increases the frangibility of the projectile rather than improving its penetrating power. To place weights at the rear of a projectile does not reduce fragmentation. Moreover, given the same effectiveness, it is desirable to have ammunition which is as light as possible for ease of transport.

Furthermore, in the usual projectile, the excessive weight situated at the rear thereof only increases its instability. In spin-stabilized projectiles stability is improved and the transverse moment of inertia is considerably less. However, the greater the mass of the base of the projectile, then the greater also is the moment of inertia and the lower the coefficient of basic stability. Similarly, in finned projectiles, stability increases when the center of gravity is moved forward and the transverse moment of inertia is reduced. Thus, increasing the mass of the base reduces stability both for finned and spin-stabilized projectiles.

OBJECTS OF THE INVENTION

The principal object of the invention is to create a projectile whose mass at the rear is reduced but which is nevertheless capable of withstanding the pressure prevailing within the gun barrel.

Another object of the invention is to transmit the pressure to the projectile charge by giving the charge, insofar as this is possible, the properties of an isotropic and only slightly compressible body, so that the walls of the base of the projectile will be subject to substantially the same internal and external pressure. This projectile thus operates in the elasto-plastic range, that is to say, it is capable of retaining its shape and cohesion even when subjected to a compressive stress greater than the shear stresses which can be tolerated in the elastic range.

Still another object of the invention is to create a projectile in which all or part of its internal charge is produced in such a way as to be isotropic and only slightly compressible, and in that at least part of the wall of the base, which contains it, is deformable or movable, as a result of which the external pressure is transmitted to the internal charge and compressibility is taken up by deformation of the base.

A still further object of the invention is to arrange the deformable or movable part in such a way so as to adjust the internal space set aside for all or part of the charge to the actual volume of the latter, which volume may vary with temperature. This design is intended to eliminate any free space between the charge and its container for such. A space would give rise to an undesirable impact effect at the time when external pressure is transmitted. Depending on the type of part which transmits external pressure, the clearance may be taken up either by elastic deformation of the part itself, if the part is deformable, or, if the part is movable, by an elastic member which holds the part pressed against the internal charge, or possibly by both means if the part is simultaneously movable and deformable.

Other objects and advantages of the present invention will be more readily apparent from a further consideration of the following detailed description of the drawings illustrating a preferred embodiment of the invention, in which:

DETAILED DESCRIPTION

Figure 1:
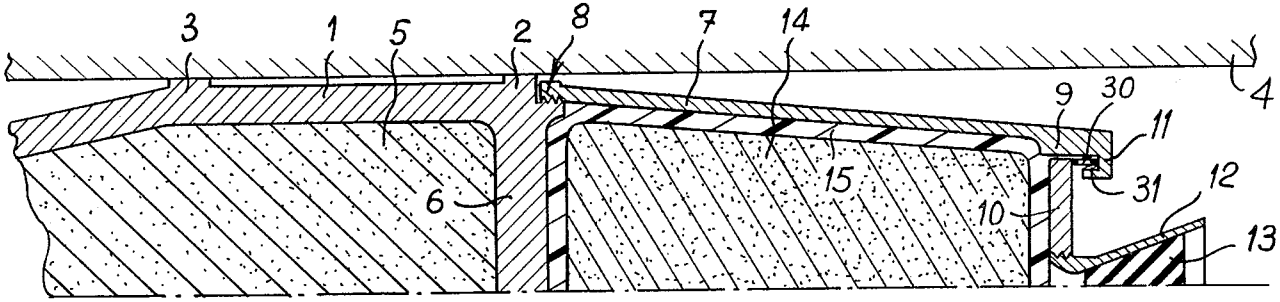
FIG. 1 is a fragmentary cross-sectional view of a semi-self-propelled projectile.

Turning now to the drawings, FIG. 1 is a schematic view in longitudinal cross-section looking into one half of a section of a semi-self-propelled projectile according to the invention. At 1 is shown a fragmentary portion of the projectile body with a rearwardly disposed annular driving or rim band 2 and a Bourrelet rim or band 3 positioned between the band 2 and the ogive with each of the bands arranged to ride on the lands on the wall 4 of the gun barrel. An explosive charge 5 is contained within the space formed by the body of the projectile and the shock resistant partition 6 which includes the threaded annular flange, as shown. The constricted portion 7 of the skirt-shaped base is secured to the flange on the rear of the projectile as shown at 8 by threads, but it is understood that the method of attachment could be of any suitable type such as crimping, for example. In accordance with the invention, this skirt is much thinner and lighter in weight that the remainder of the body of the projectile, being approximately 2 millimeters thick in the case of a 120 mm projectile.

The terminus of the skirt 7 is formed with a cylindrical aperture 9 and a reentrant portion 11 forms a seat for a flexible corrugated ring means 30 which is adapted to maintain the piston 10 in the position shown. The piston 10 is associated with a nozzle 12 in a known way, for example by threading or moulding, said nozzle being provided with a plug 13, which in a known manner may contain a delay fuse which causes the plug to be ejected and propellant charge 14 to be lit.

The propellant charge 14 is contained in a space bounded by the surrounding wall of the skirt 7, the partition 6 and the movable piston 10 and is enveloped in a plastic coating 15 and thus fills up any gaps which might exist between the charge 14 and the wall of the skirt. In addition, piston 10 is tightly pressed against charge 14 by the flexible corrugated ring 30 so as to compensate for changes in the volume of the charge.

Although the flexible corrugated ring is shown being used as the elastic means by which the piston is loaded, it is to be understood that any other elastic means of small bulk would be suitable. The elastic mounting of piston 10 has still another advantage, since when the propellant charge 14 is lit, the piston 10 moves back under the pressure of the expanding gases until a state of equilibrium is reached with the opposing action of the flexible ring 30. Consequently, the piston opens a gap between itself and the emitting surface of the block of explosive powder in order to allow an unobstructed flow of combustion gas.

During the ballistics phase, the following takes place. The pressure wave which is set up on firing is propagated inside the barrel from the right to the left of the Figure. It exerts its force against the rear of the projectile, i.e., piston 10, at the same time as it continues to move forward between the wall 4 of the barrel and the skirt 7 of the projectile. Naturally the skirt-shaped portion 7 is of light gauge and is unable alone to withstand the pressure to which it is subjected. However, piston 10 is now exerting pressure against the charge 14 which, as explained earlier herein, is enveloped in its plastic coating 15. Thus, the charge 14 transmits its pressure in all directions and in particular in a direction at right angles to the skirt 7, i.e., from the inside outwardly. This pressure is substantially the same as the external pressure which is exerted on the skirt in the opposite direction, i.e., from the outside inwardly. Thus, since the skirt is subjected to only slight radial stresses as a result, it is possible for it to be of only a small thickness that is sufficient for it to withstand the initial shock. Basically, it should be sufficiently thick to be capable of subsequently withstanding the working pressure from propellant 14.

It should be noted that the intermediate partition 6 need only be able to withstand the pressure transmitted by charge 14.

According to the invention, one seeks to have, so far as possible, a pressure transmitted by the charge to the skirt at least equal to that exerted by the propellant gases within the barrel, whatever the time and the point on the skirt which are considered. It is in effect preferable for the skirt to operate in traction under an internal over-pressure rather than in compression under an external over-pressure. To achieve this it is necessary for the mass of the piston 10 which transmits the pressure to charge 14 to be as low as possible and also for the charge 14 to have the characteristics required for it to transmit in all directions the pressure which it receives on its rear face.

As regards the mass of piston 10, it can be said that the movement of the piston under the effect of the pressure will be slower, all other things being equal, as the mass in question is higher. In other words, at the end of a given period during which the pressure prevailing within the barrel is applied, the distance travelled by the movable piston 10 will be inversely proportional to the mass of the piston; however, the pressure exerted by the piston on the charge 14 rises with this movement. It will therefore be appreciated that, if it is desired that the pressure transmitted to charge 14 approximates as closely as possible the propulsive pressure applied to piston 10, it is necessary for the mass of the latter to be as low as possible. Furthermore, if there is a choice between a number of explosive propellant powders, the powder selected will be the one that is the least compressible and which requires the least movement on the part of the piston, i.e., one which will transmit the pressure most satisfactorily.

It has also been seen that, so that the skirt 7 can undergo the pressure due to propulsion which is exerted externally without suffering damage, it is necessary that the pressure which is transmited to the charge 14 by piston 10 should in turn be exerted in all directions and, in particular, in a sideways direction towards the exterior of skirt 7. To achieve this, it is necessary that the materials which fill the space defined by the intermediate partition 6, the skirt 7 and the piston 10 should, when considered as a whole, behave as an incompressible liquid in the pressure range concerned. Since at these pressures the powder used for the propellant charge 14 operates largely in the plastic range, it will have a Poisson coefficient close to 0.5, i.e., very close to that of a liquid.

It has, however, been noted that, in order for the pressures to be transmitted in the space concerned under the desired conditions, it is necessary for all the materials contained in the said space to have these same characteristics. This would be the case, if, for example, the propellant powder 14 occupied the whole of the space set aside for it. It is not, however, possible to meet this condition since the explosive powder takes the form of a solid cake and there can be no question of machining the cake to the exact dimensions of the space to be filled without leaving an undesired empty space.

As explained earlier herein, one feature of the invention is that the cake of propellant powder is enveloped in a plastic material which fills the entire container. At the pressures employed, the material in question behaves like an ideal liquid with a Poisson coefficient very close to 0.5.

To apply the plastic coating 15, a cold-polymerizable material for example is used, which is introduced in liquid form prior to the cake of powder, which latter, when placed in the space prepared for it, forces out the excess polymerizable material, thereby filling any gaps which might exist between itself and the skirt. The polymerizable material then solidifies and ensures that the cake of powder is held in position in the ideal way, with no gaps being left. Using another method, the polymerizable material is introduced into the skirt in the liquid state after the cake of propellant powder has been placed in position.

The other figures disclose further embodiments of the invention as applied to other types of projectiles, with the same reference numerals denoting similar parts.

Figure 2:
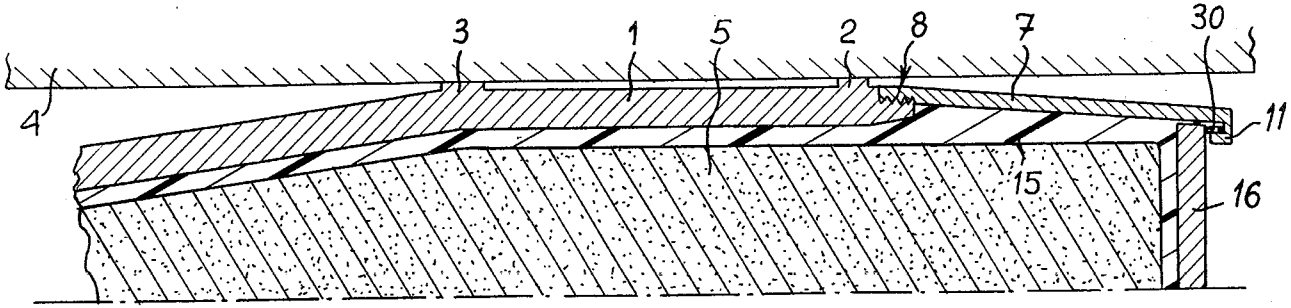
FIG. 2 is a fragmentary cross-sectional view of a non-self-propelled projectile.

FIG. 2 is a cross-section of one-half of a non-self-propelled projectile. In this case the piston 10 with its nozzle 12 is replaced by a mobile piston 16 and there is no intermediate portition 6. The whole of the explosive charge 5 receives the propulsive pressure as a result of the movement of movable piston 16. The explosive charge 5 needs to be capable of withstanding without damage the pressure transmitted by the piston and also of behaving as a liquid at the pressures involved. Furthermore, unlike the self-propelled projectile in FIG. 1 in which it was the intermediate partition 6 which bore the pressure from charge 14, here it is the entire body 1 of the projectile which must withstand the pressure. Accordingly, this factor will be taken into consideration when the projectile is constructed. Nevertheless, it will be appreciated that the strain on the charge decreases from the rear to the front of the projectile as a result of its acceleration in the gun barrel.

For the same reasons as those given above, and using the same methods, the entire explosive charge 5 is enveloped in the plastic material 15, as explained earlier herein.

Figure 3:
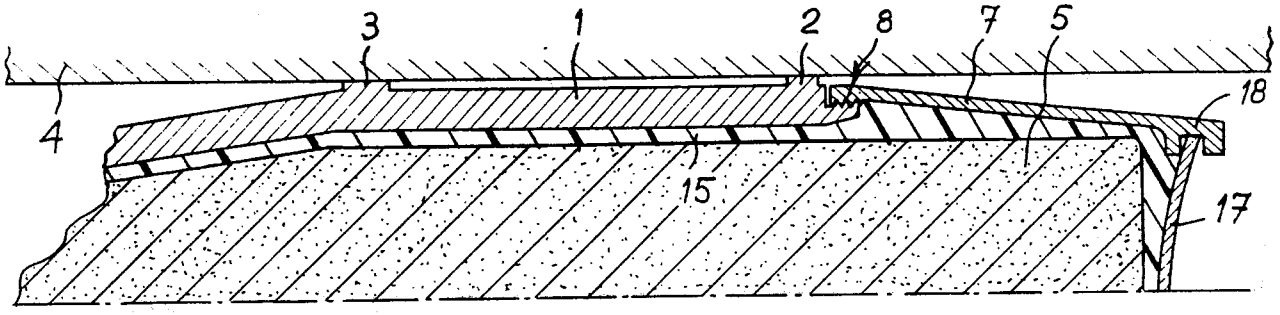
FIG. 3 is a fragmentary cross-sectional view of another embodiment of the structure shown in FIG. 2.

FIG. 3 shows a modification of the structural embodiment disclosed in FIG. 2. The piston 16 is replaced by a concave shaped deformable metal diaphragm 17 and its perimeter is confined within the groove 18 provided at the rear of the skirt 7. In this structure, pressure is transmitted to the interior of the projectile as a result of the deformation of the diaphragm and not as a result of the movement of a piston as disclosed in the previous embodiments. Similarly, any gaps of thermal origin are taken up by the elastic deformation of the diaphragm alone and not by the separate elastic element described in connection with FIG. 1.

Figure 4:
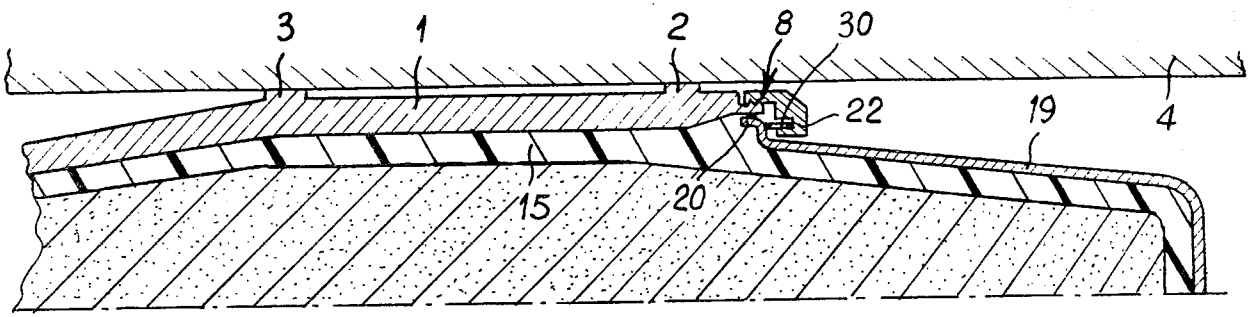
FIG. 4 is a fragmentary cross-sectional view of still another embodiment of the structure shown in FIG. 2.
Figure 5:
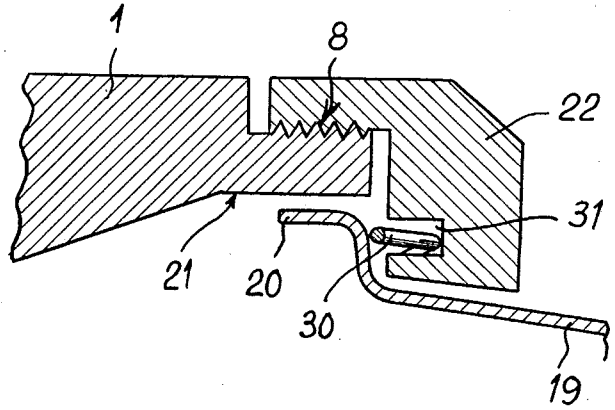
FIG. 5 is a fragmentary view in detail of the threaded connection shown in FIG. 4.

In the embodiment of the invention shown in FIG. 4, the skirt and the metallic deformable diaphragm or piston are replace by a cup-shaped receptacle 19, which may be stamped from lightweight sheet-metal, for example. The circumferential lip 20 of the receptacle 19 (FIG. 5) is arranged so that it can slide on a bearing face 21 provided for the purpose in the rear of the body 1 of the projectile, thus producing a sliding joint. The receptacle 19 is held in by means of a flexible ring 30 which in turn is retained in a groove 31 that is machined in the ring 22. The ring 22 is threadedly secured at 8 to the projectile as disclosed in the previous embodiments.

It is to be understood that other means may be provided for attaching the receptacle 19 to the body 1 of the projectile and that the sliding-joint type of construction has been disclosed merely as one possible illustration. However, whatever method is used to couple the receptacle 19 to the body 1, it is necessary to make provision for relative movement between the projectile and the receptacle all of which should be understood by those skilled in the art.

Thus it can be appreciated from the foregoing that, in this embodiment of the invention, the pressure is transmitted to the inside of charge 5 as a result of movement in a forward direction of the whole rear section of the projectile, which is formed by the receptacle 19 and a part of charge 5, and not simply by the movement of the rear face of the projectile when it is formed by a piston or a deformable diaphragm.

Figure 6:
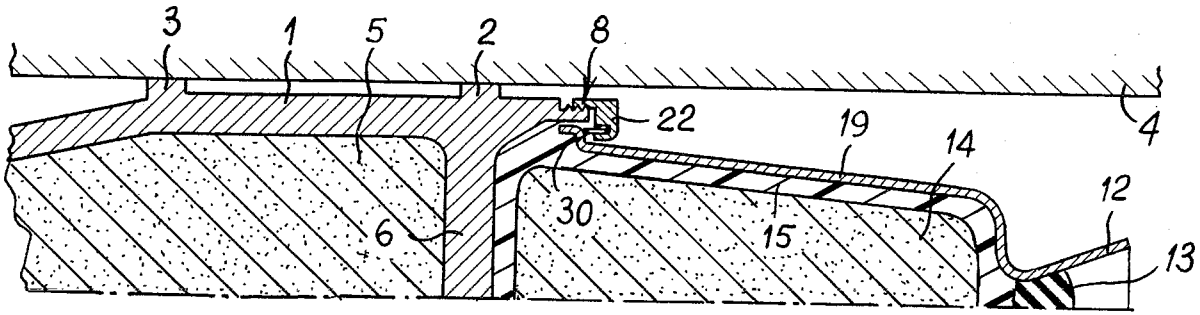
FIG. 6 is a further embodiment of the invention relative to the semi-self-propelled projectile shown in FIG. 1.

As a modification (FIG. 6) to this latter embodiment, the rear face of the receptacle 19 contains a propulsion nozzle 12 and the body 1 of the projectile, as in the embodiment described with reference to FIG. 1, contains a wall 6 which separates the explosive charge 5 from the propellant charge 14. In this instance, the transmission of pressure as a result of the movement of holder 19 takes place solely within the space occupied by the propellant charge 14.

Figure 7:
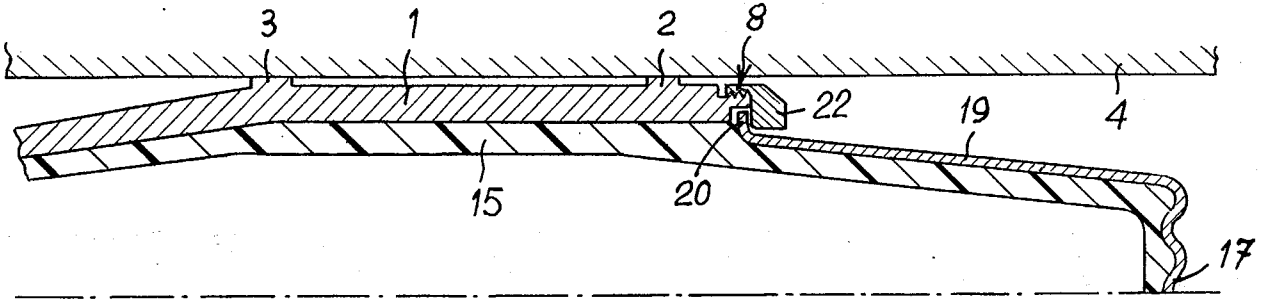
FIG. 7 is a fragmentary cross-sectional view of another embodiment of the structure of FIG. 2.

In the embodiment of the invention shown in FIG. 7, which relates to a non-self-propelled projectile, the cup-shaped receptacle 19 has a rear end-wall 17 which is elastically deformable. This wall contains concentric corrugations so that it has satisfactory elasticity in the longitudinal direction of the projectile. In this construction the receptacle 19 is held in position relative to the body 1 of the projectile by its outwardly turned annular rim 20, with the ring 22 providing a shoulder to receive the annular rim and including a threaded area 8 similar to the arrangement described relative to previous embodiments.

Thus, it will be understood that in this embodiment, external pressure is transmitted and clearance taken up as a result of the deformation of the rear end-wall in a similar way to the embodiment in FIG. 3.

Figure 8:
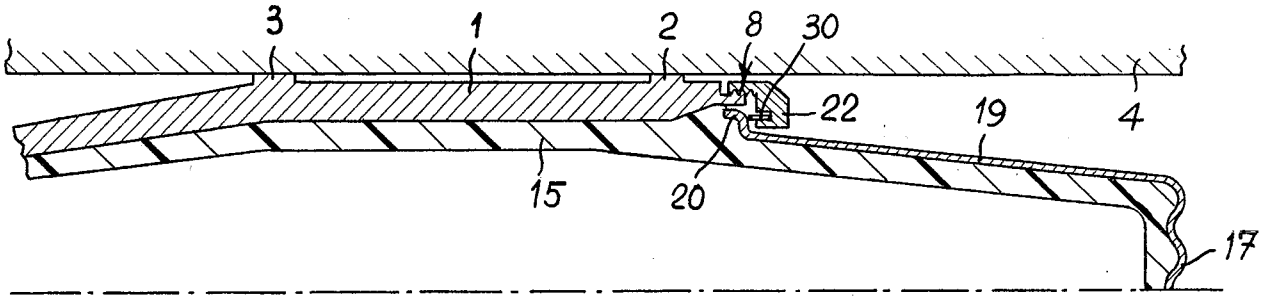
FIG. 8 is a fragmentary cross-sectional view of still another embodiment of the structure of FIG. 2.

FIG. 8 shows a further modification of the embodiments disclosed in FIG. 7 and FIG. 4. The receptacle 19 has an elastically deformable rear end-wall 17 and is mounted on the body 1 of the projectile so as to be able to slide therein as in the embodiment in FIG. 4.

In FIG. 8 pressure is transmitted both by the movement of the receptacle 19 and by the deformation of its rear end-wall 17 and necessary clearance is provided by the flexible ring 30 and the elasticity of the rear end-wall 17.

The invention as disclosed herein in all embodiments is also applicable to projectiles which are equipped with a complex propellant charge.

Figure 9:
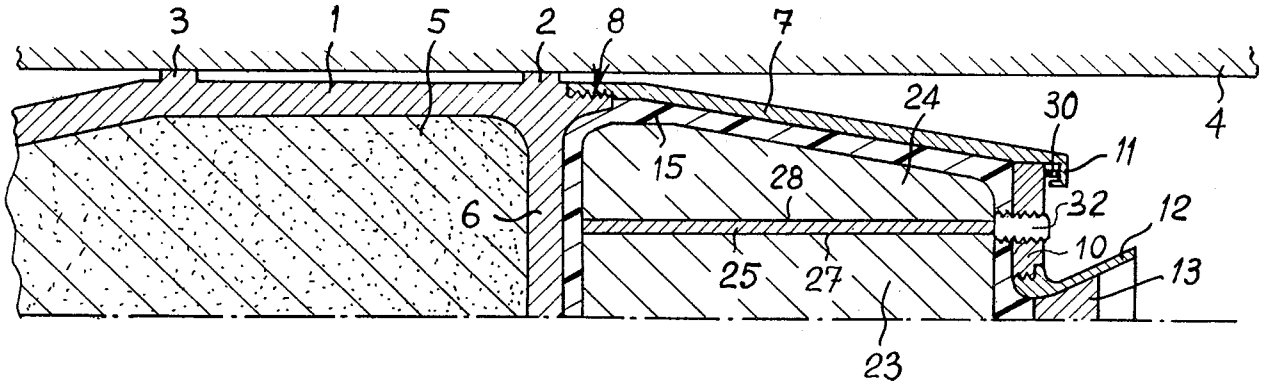
FIG. 9 is a fragmentary cross-sectional view of a further embodiment of the structure of FIG. 1.

FIG. 9 is a still further modification of the embodiment of the invention disclosed in FIG. 1. The propellant charge, instead of being in a single element, is formed from two concentric elements 23 and 24. The tubular gap between the two blocks is filled with a slightly compressible material 25, the function of which is the same as that of coating 15 during the compression phase, but which also allows the propellant elements to be ignited along their confronting surfaces 27 and 28, respectively. This flammable substance is ignited by, for example, one or more igniters 32 situated in piston 10.

Figure 10:
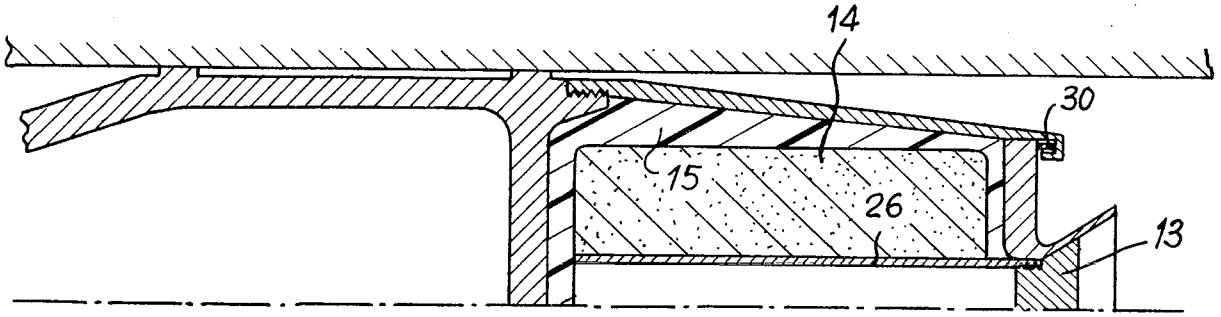
FIG. 10 is a fragmentary cross-sectional view of still another embodiment of the structure of FIG. 1.

FIG. 10 shows still another modification of the embodiment of the invention in FIG. 1. The propellant charge 14 is of the radial burning type containing a central opening which may be cylindrical, star-shaped, etc. As in the embodiment disclosed in FIG. 1, the block of propellant is enveloped in a plastic coating 15. To prevent the explosive powder from crumbling into the elongated perforation provided in the propellant when the firing operation takes place, a strong tubular member 26, for example, which is closely matched to the shape of the perforation is arranged to support the walls of the elongated perforation. This tubular member is fixed to the nozzle plug 13, by screwing for example. When the block of propellant is ignited, the tubular member 26 and the nozzle plug 13 are ejected rearwardly and thus leaves the propellant free to burn out through the nozzle.

I claim:

1. A projectile comprising an elongated body element including a forwardly extending ogive nose portion and a rearwardly extending removable base portion, at least one isotropic, incompressible explosive charge in said body, said base portion being urged against said charge by resilient means interposed between the elongated body element and said base portion.

2. A projectile as claimed in claim 1, in which said resilient means is supported by further means associated with said elongated body.

3. A projectile as claimed in claim 2, in which said further means is threadedly secured to said elongated body.

4. A projectile as claimed in claim 1, in which the removable base portion includes an annular rim means.

5. A projectile as claimed in claim 4, in which said removable base portion includes a portion adapted to shroud the annular rim means.

6. A projectile as claimed in claim 1, in which the base portion also includes a terminal nozzle element.

7. A projectile as claimed in claim 1, in which the base portion also includes a deformable end wall.

8. A projectile as claimed in claim 1, in which the explosive charge is coated with a plastic material.

9. A projectile as claimed in claim 8, in which the plastic material is a cold-polymerizable product.

* * * * *